US006269721B1

(12) United States Patent
Tseng

(10) Patent No.: US 6,269,721 B1
(45) **Date of Patent: *Aug. 7, 2001**

(54) ELECTRIC PAPER PUNCH

(75) Inventor: Tzu-Feng Tseng, Taipei Hsien (TW)

(73) Assignee: Primax Electronics Ltd., Taipei Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/201,317

(22) Filed: Nov. 27, 1998

(51) Int. Cl.[7] ..... B26F 1/00

(52) U.S. Cl. ..... 83/618; 83/628; 83/859; 83/635

(58) Field of Search ..... 83/613, 628, 859, 83/618, 620, 860, 633, 635

(56) References Cited

U.S. PATENT DOCUMENTS

| | | | | |
|---|---|---|---|---|
| 756,902 | * | 4/1904 | Shoemaker | 83/628 |
| 909,285 | * | 1/1909 | Denburger | 83/628 |
| 1,243,656 | * | 10/1917 | Cobb | 83/628 |
| 1,312,067 | * | 8/1919 | Webster | 83/628 |
| 1,553,378 | * | 9/1925 | Harper | 83/628 |
| 2,745,492 | * | 5/1956 | Brook | 83/628 |
| 3,387,525 | * | 6/1968 | Funke | 83/628 |
| 3,768,359 | * | 10/1973 | Koefferlein | 83/628 |
| 3,968,713 | * | 7/1976 | Mosburger | 83/343 |
| 3,987,695 | * | 10/1976 | Neilson | 83/628 |
| 4,987,811 | * | 1/1991 | Ikarashi et al. | 83/628 |
| 5,178,049 | * | 1/1993 | Tsai-Hsin | 83/164 |
| 5,588,344 | * | 12/1996 | Chun | 83/628 |
| 5,664,473 | * | 9/1997 | Huang | 83/620 |

* cited by examiner

*Primary Examiner*—Kenneth E. Peterson
*Assistant Examiner*—Kim Ngoc Tran
(74) *Attorney, Agent, or Firm*—Winston Hsu

(57) ABSTRACT

The present invention provides an electric paper punch (hole puncher) with a reinforcement mechanism. The paper punch comprises a module with a paper slot and punch pin, an axle, a connecting module connected to the punch pin, and a motor. The connecting module has a rear wall that is arc-shaped and works in conjunction with an eccentrically shaped wheel to drive the punch pin forward and backward as the eccentrically shaped wheel rotates within the wheel groove. The arc-shaped wall of the connecting module is reinforced to prevent distortion from repeated pressure exerted during movement of the punch pin.

1 Claim, 6 Drawing Sheets

ELECTRIC PAPER PUNCH

BACKGROUND OF THE INVENTION

1. Field of the Invention

The invention relates to an electric paper punch, and more particularly, to an electric paper punch comprising a reinforcement mechanism.

2. Description of the Prior Art

A standard paper punch uses a punch pin to punch holes through paper loaded in it paper slot. There are two kinds of paper punches: manual and electric. With the manual paper punch, a lever arm is depressed to punch holes through paper with the punch pin and the punch pin is rebounded by a spring attached to the punch pin when the lever arm is released. The amount of paper the manual paper punch can handle at once is directly related to the length of the lever arm. The longer the lever arm, the more paper can be accommodated. However, the spring must have great elasticity in order to allow the punch pin to return to its original resting position.

In a typical electric paper punch, the punch pin is advanced with an electric motor. Please refer to FIG. 1 and FIG. 2. FIG. 1 is a perspective diagram of a prior art electric paper punch 10. FIG. 2 is a perspective diagram of a connecting module 12 of the electric paper punch 10 in FIG. 1. The electric paper punch 10 comprises three connecting modules 12. Each connecting module 12 comprises an opening 16 at its front end for supporting a punch pin 18, an eccentric wheel 19 installed above a bottom side of the connecting module 12, and an arc-shaped wall 14 at a rear end of the connecting module 12.

During operation, the eccentric wheel 19 pushes the connecting module 12 and punch pin 18 forward to punch holes in paper placed in the paper slot 17. Then, the eccentric wheel 19 will push the arc-shaped wall 14 of the connecting module 12 back. Because the rear end of the punch pin 18 is connected with two sides of the opening 16 of the connecting module 12, the connecting module 12 will pull the punch pin 18 back at the same time. However, this backward force may cause distortion of the arc-shaped wall 14 of the connecting module 12.

SUMMARY OF THE INVENTION

It is therefore a primary objective of the present invention to provide an electric paper punch comprising a reinforcement mechanism to solve the mentioned problem.

Briefly, in a preferred embodiment, the present invention provides an electric paper punch comprising:

a housing;

a punch module for punching a hole in papers comprising a punch base fixed in the housing with a paper slot for loading papers to be punched, and a punch pin slidably installed in the punch base for punching a hole through the papers loaded in the paper slot;

an axle rotatably installed in the housing comprising an eccentric wheel for driving the punch pin forward and backward;

a connecting module installed in the housing under the eccentric wheel in a forward-and-backward slidable manner, the connecting module comprising a front end connected to a rear end of the punch pin, a wheel groove positioned under the eccentric wheel for allowing the eccentric wheel to rotate in it, and an arc-shaped wall forming a rear end of the wheel groove wherein the punch pin and the connecting module will be driven forward to punch the papers in the paper slot when the eccentric wheel is rotated forward within the wheel groove, and the arc-shaped wall will be pushed backward by the eccentric wheel to move the connecting module and the punch pin away from the paper slot when the eccentric wheel is rotated backward; and a motor installed in the housing for rotating the axle so as to rotate the eccentric wheel forward and backward;

wherein the connecting module further comprises a reinforcement mechanism for strengthening the arc-shaped wall of the connecting module so as to avoid distortion of the arc-shaped wall caused by pulling the punch pin backward away from the paper slot.

It is an advantage of the present invention that the electric paper punch according to the present invention has a reinforcement mechanism that prevents distortion of the connecting module and can punch holes through more paper at once.

These and other objects and the advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 3:
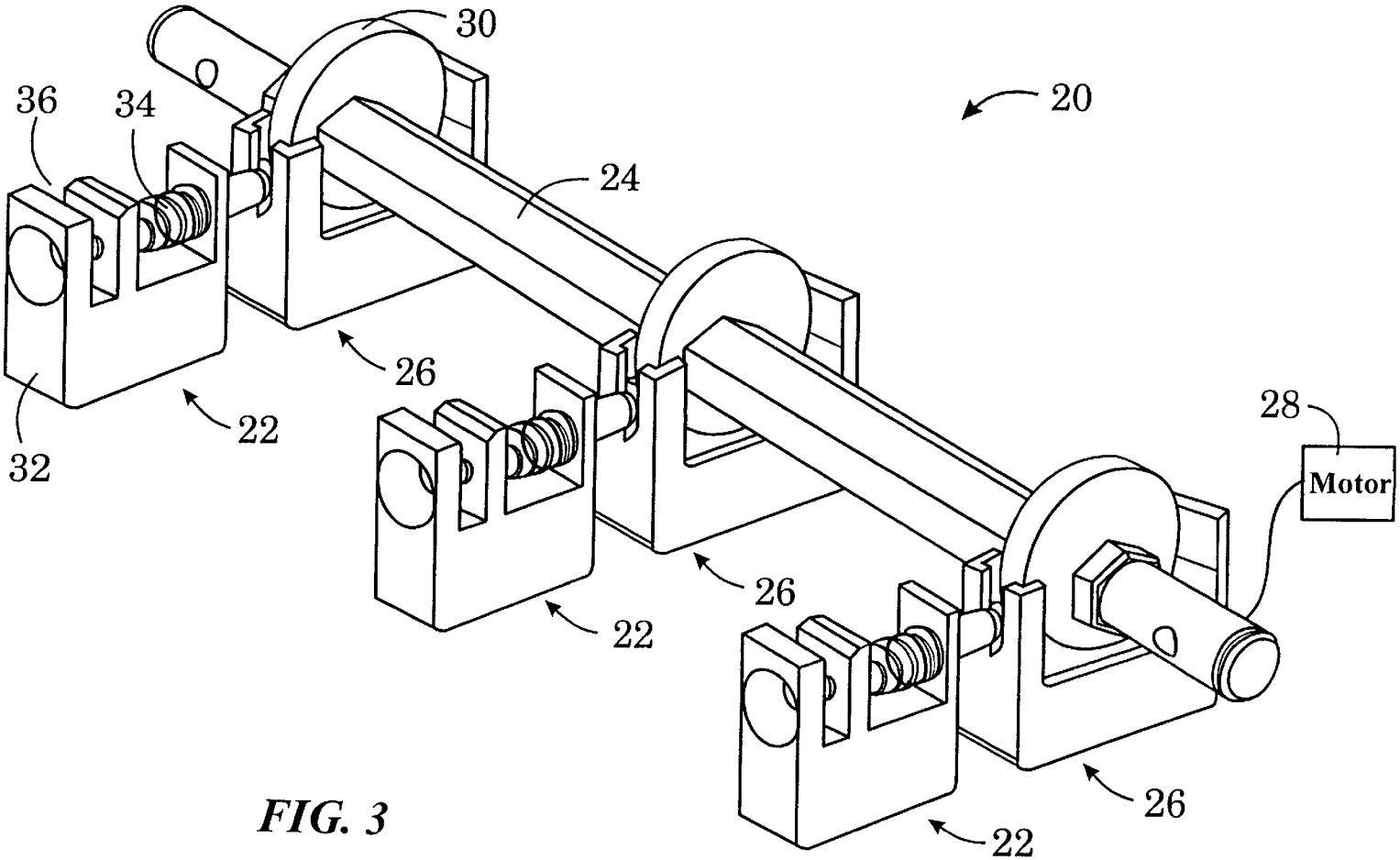
FIG. 3 is a perspective diagram of an electric paper punch according to the present invention.
Figure 4:
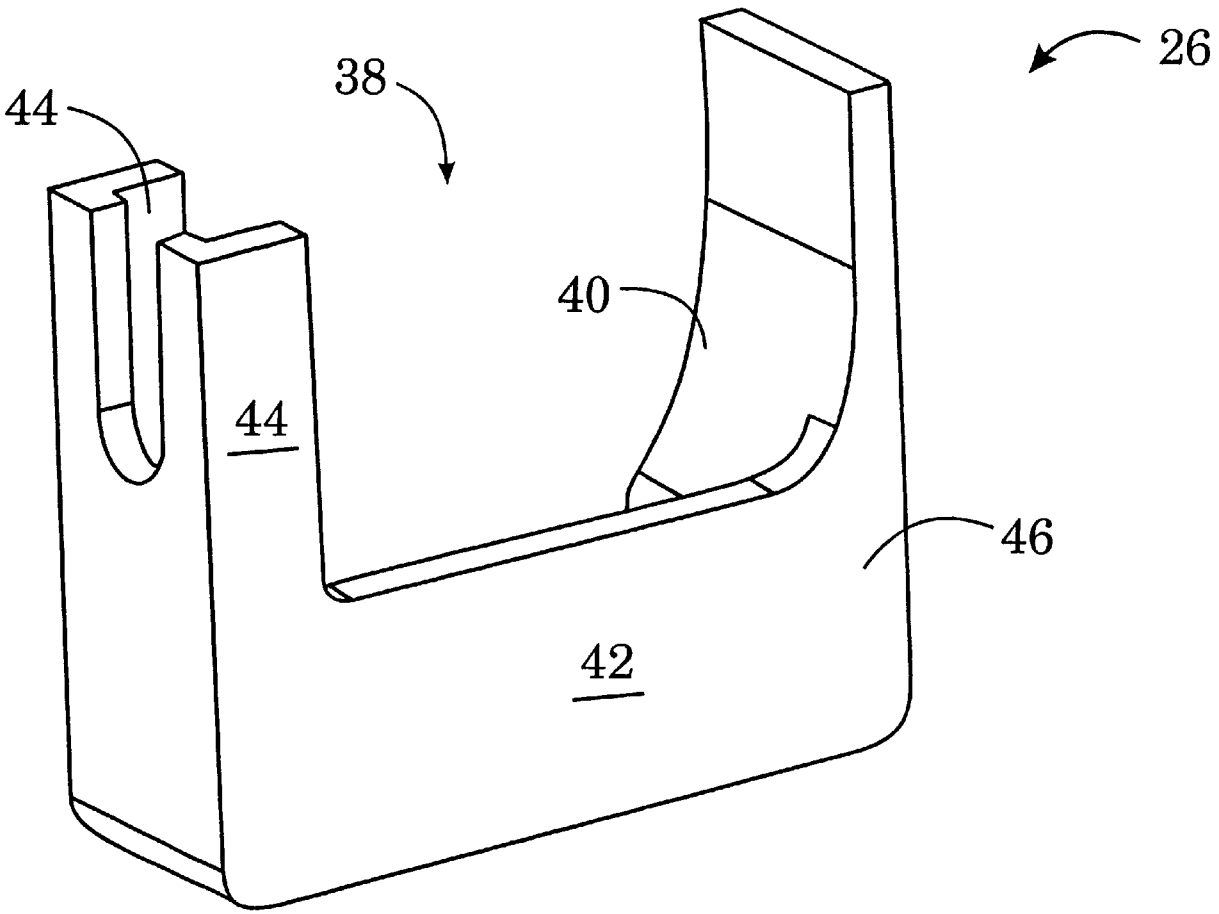
FIG. 4 is a perspective diagram of a connecting module shown in FIG. 3.

Please refer to FIG. 3 and FIG. 4. FIG. 3 is a perspective diagram of an electric paper punch 20 according to the present invention. FIG. 4 is a perspective diagram of a connecting module 26 shown in FIG. 3. The electric paper punch 20 comprises a housing (not shown), three punch modules 22 for punching holes, an axle 24 rotatably installed in the housing, three connecting modules 26 installed in the housing in a forward-and-backward slidable manner, and a motor 28 installed in the housing.

Each punch module 22 comprises a punch base 32 fixed in the housing with a paper slot 36 to load paper to be punched and a punch pin 34 slidably installed in the punch base 32 for punching a hole through paper loaded in the paper slot 30 36. The axle 24 comprises three eccentric wheels 30 for driving the punch pin 34 forward and backward. The connecting modules 26 are installed under the eccentric wheels 30 and comprises a front end 27 connected to a rear end of the punch pin 34. The motor 28 is used for rotating the axle 24 so as to make the eccentric wheel 30 drive the punch pin 34 forward and backward.

Each connecting module 26 comprises a wheel groove 38 having a top opening and having a rear end formed by an arc-shaped wall 40. The punch pin 34 and the connecting module 26 are driven forward to punch paper in the paper slot 36 when the eccentric wheel 30 is rotated forward within the wheel groove 38. Conversely, when the eccentric wheel 30 is rotated backward, the arc-shaped wall 40 is pushed backward and the connecting module 26 and the punch pin 34 are moved away from the paper slot 36.

Each connecting module 26 comprises a vertical side wall 42, two vertical flanges 44, and a solid angle structure 46. The vertical side wall 42 is integrally built between the front end and the arc-shaped wall 40 of the connecting module 26 and reinforces the side of the wheel groove 38 to prevent distortion through backward force exerted on the arc-shaped wall 40. The two vertical flanges 44 are integrally built at two sides of the front end of the connecting module 26 to strengthen it. The solid angle structure 46 is integrally built behind the arc-shaped wall 40 of the connecting module 26 for strengthening the arc-shaped wall 40 of the connecting module 26.

Figure 1:
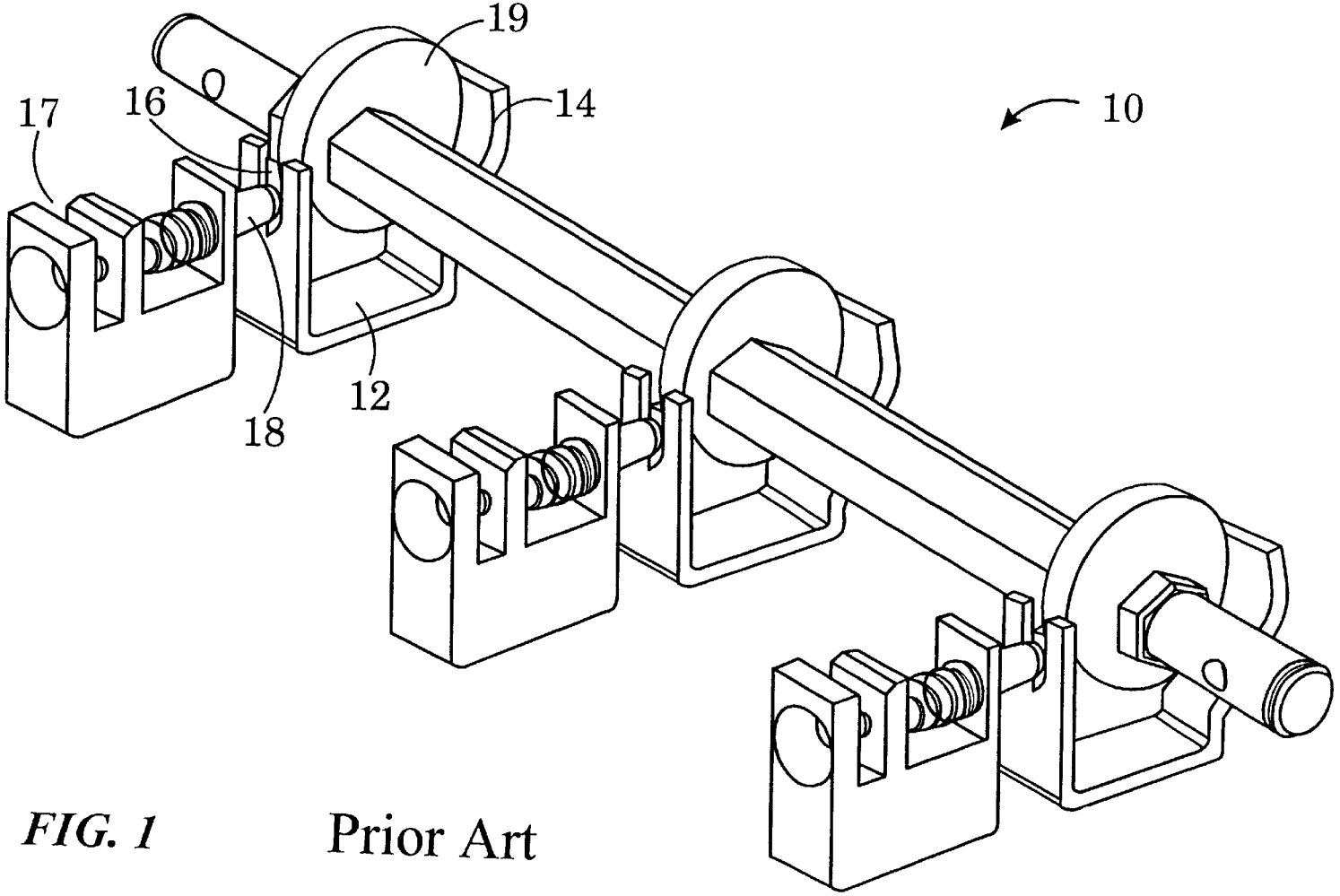
FIG. 1 Prior Art
FIG. 1 is a perspective diagram of a prior art electric paper punch.
Figure 2:
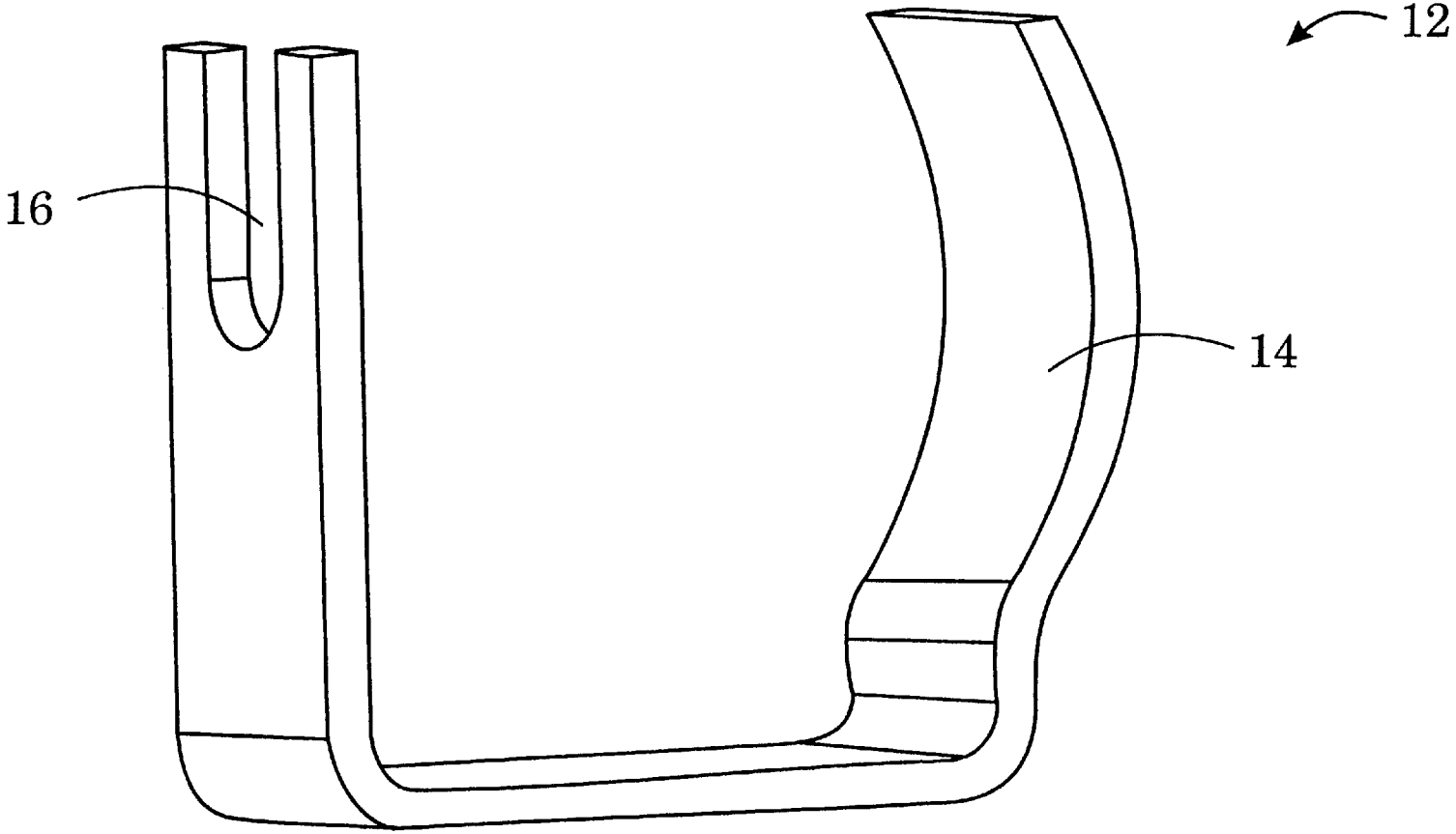
FIG. 2 Prior Art
FIG. 2 is a perspective diagram of a connecting module of the electric paper punch in FIG. 1.
Figure 5:
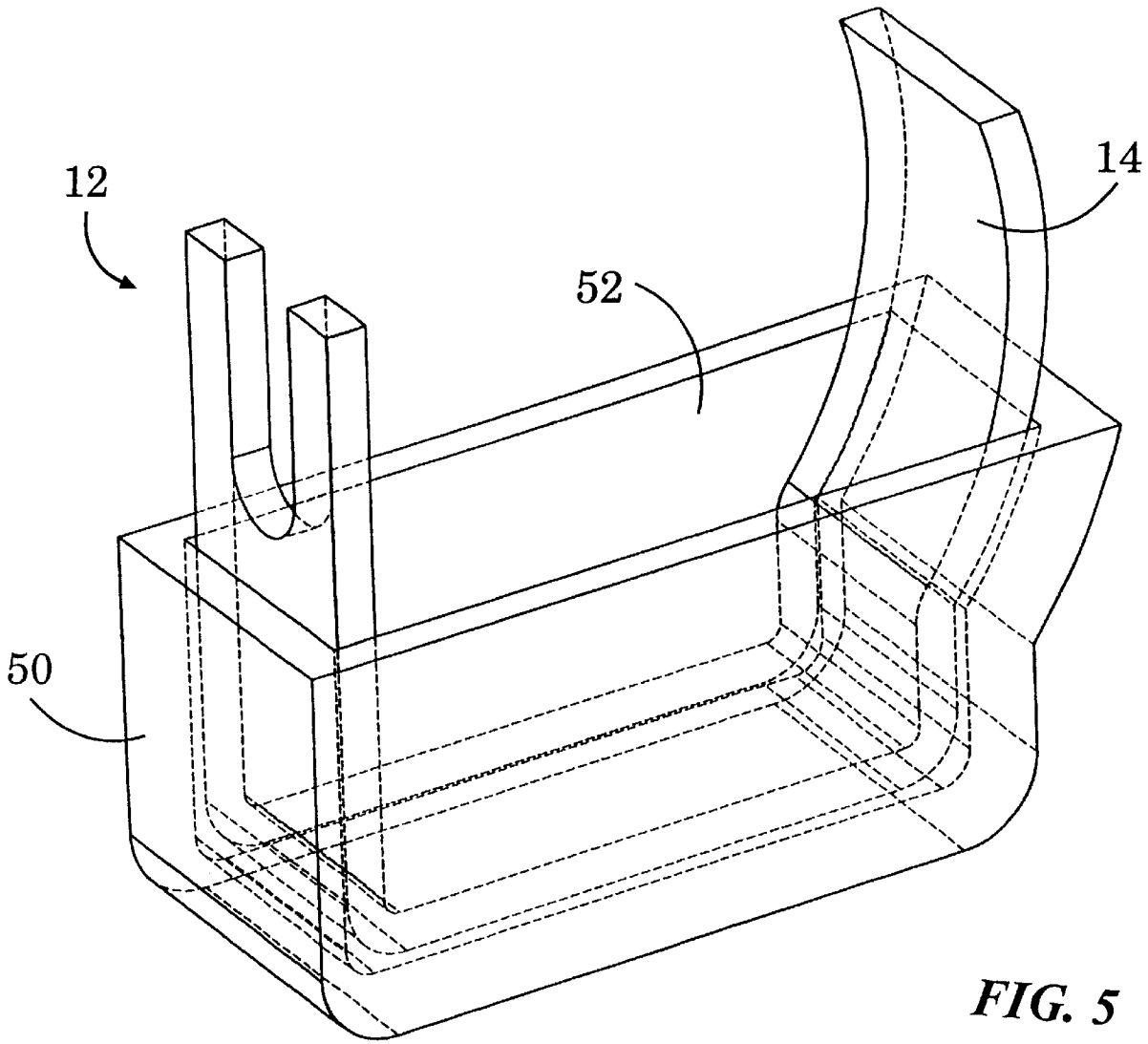
FIG. 5 is another reinforcement mechanism for strengthening the connecting module shown in FIG. 2.
Figure 6:
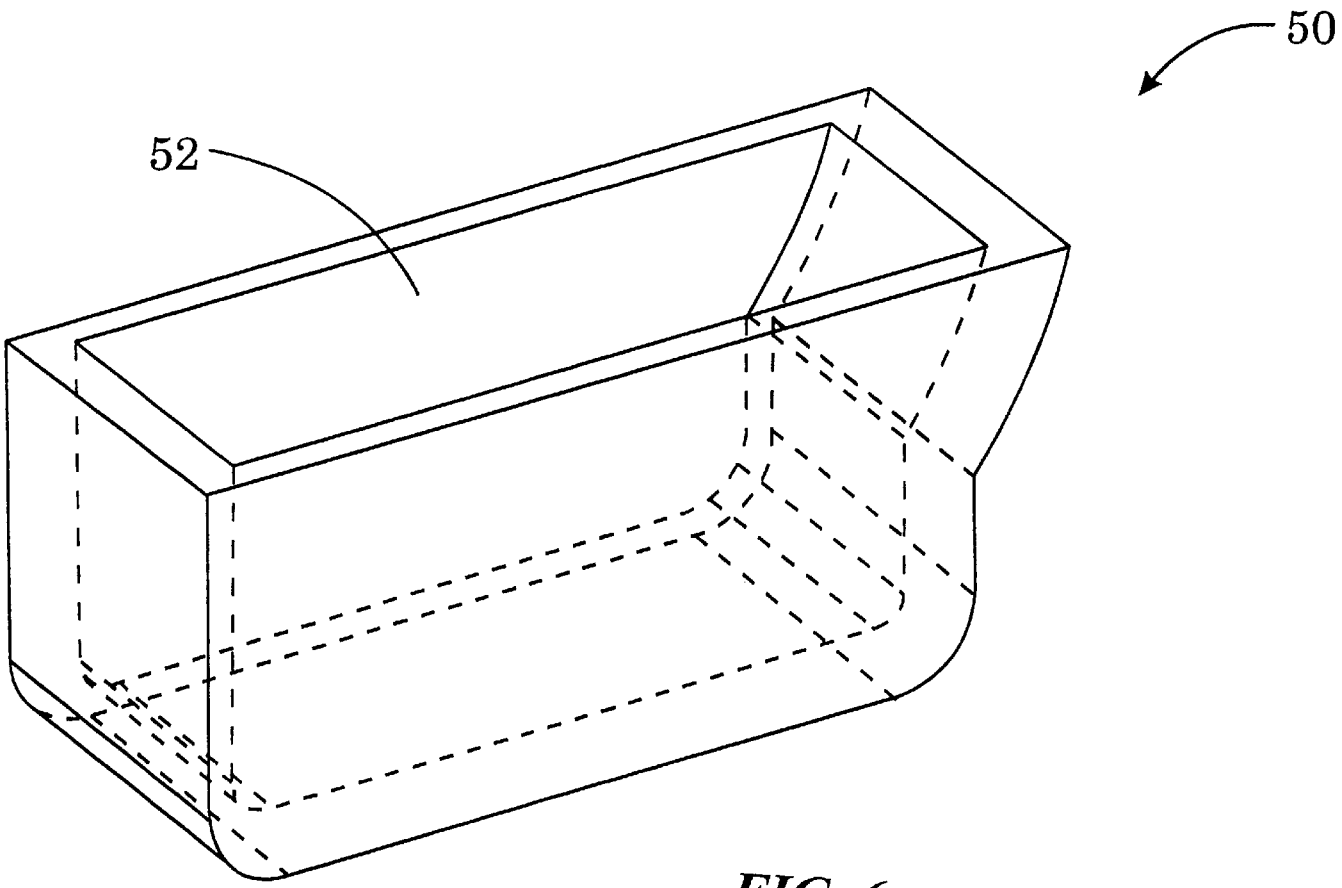
FIG. 6 is a perspective diagram of a holder shown in FIG. 5.

Please refer to FIG. 5 and FIG. 6. FIG. 5 is another reinforcement mechanism for strengthening the connecting module 12 shown in FIG. 2. FIG. 6 is a perspective diagram of a holder 50 shown in FIG. 5. In this embodiment, the holder 50 is mounted around a bottom side of the connecting module 12 for reinforcement. The holder 50 comprises a groove 52 for stabilizing the front and back sides of the connecting module 12 in the groove 52. The holder 50 provides added reinforcement to the arc-shaped wall 14 thus preventing its distortion during backward movement of the eccentric wheel 30.

Compared with the prior art electric paper punch 10, the connecting module 26 of the electric paper punch 20 according to the present invention has a reinforcement mechanism for strengthening the structure of the connecting module 26. The connecting module 26 comprises a vertical side wall 42, two vertical flanges 44, and a solid angle structure 46 for strengthening the connecting module 26 and preventing distortion of the arc-shaped wall 40. The reinforcement mechanism can be a holder 50 mounted around a bottom side of the connecting module 12 for reinforcing it. The electric paper punch 20 according to the present invention not only has a reinforcement mechanism for preventing distortion of the connecting module 26, but also can punch holes through more paper at once.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. An electric paper punch comprising:

a housing;

a punch module for punching a hole in papers comprising a punch base fixed in the housing with a paper slot for loading papers to be punched, and a punch pin slidably installed in the punch base for punching a hole through the papers loaded in the paper slot;

an axle rotatably installed in the housing comprising an eccentric wheel for driving the punch pin forward and backward;

a connecting module installed in the housing under the eccentric wheel in a forward-and-backward slidable manner, the connecting module comprising a front end connected to a rear end of the punch pin, a wheel groove positioned under the eccentric wheel for allowing the eccentric wheel to rotate in it, and an arc-shaped wall forming a rear end of the wheel groove wherein the punch pin and the connecting module will be driven forward to punch the papers in the paper slot when the eccentric wheel is rotated forward within the wheel groove, and the arc-shaped wall will be pushed backward by the eccentric wheel to move the connecting module and the punch pin away from the paper slot when the eccentric wheel is rotated backward; and a motor installed in the housing for rotating the axle so as to rotate the eccentric wheel forward and backward;

wherein the connecting module further comprises a holder mounted around a bottom side of the connecting module and comprises a groove defining vertical side walls for tightly holding the bottom side of the connecting module for strengthening the arc-shaped wall of the connecting module so as to avoid distortion of the arc-shaped wall caused by pulling the punch pin backward away from the paper slot.

* * * * *